US005643860A

United States Patent [19]

Mella

[11] Patent Number: 5,643,860

[45] Date of Patent: Jul. 1, 1997

[54] CLEANING COMPOSITION FOR PIPES AND COILS OF A REFRIGERATION SYSTEM

[75] Inventor: Steven P. Mella, Stamford, Conn.

[73] Assignee: Comstar International, Inc., College Point, N.Y.

[21] Appl. No.: 599,281

[22] Filed: Feb. 8, 1996

Related U.S. Application Data

[63] Continuation of Ser. No. 238,919, May 6, 1994, abandoned.

[51] Int. Cl.[6] ..... C11D 7/26

[52] U.S. Cl. ..... 510/245; 510/365; 510/505; 510/506

[58] Field of Search ..... 510/245, 254, 510/505, 506, 365

[56] References Cited

U.S. PATENT DOCUMENTS

| | | | |
|---|---|---|---|
| 2,150,334 | 3/1939 | McKittrick | 252/170 |
| 4,309,300 | 1/1982 | Danforth | 252/170 |
| 4,808,235 | 2/1989 | Woodson et al. | 252/170 |
| 4,859,359 | 8/1989 | DeMatteo et al. | 252/174.15 |
| 5,188,754 | 2/1993 | Weltman et al. | 252/162 |
| 5,227,085 | 7/1993 | Motsenbocker | 252/99 |
| 5,332,526 | 7/1994 | Stanley | 252/542 |
| 5,334,256 | 8/1994 | Howe | 252/170 |
| 5,574,002 | 11/1996 | Shino et al. | 510/202 |

FOREIGN PATENT DOCUMENTS

| | | | |
|---|---|---|---|
| 4130494 | 4/1993 | Germany | 252/170 |
| 3-153799 | 7/1991 | Japan . | |
| 3-277697 | 12/1991 | Japan | 252/170 |

*Primary Examiner*—Prince Willis, Jr.
*Assistant Examiner*—Cephia D. Toomer
*Attorney, Agent, or Firm*—John Q. McQuillan

[57] ABSTRACT

The disclosure relates to a stable multi-purpose cleaning composition for cleaning the pipes and coils of domestic and commercial refrigeration systems. The cleaning composition comprises a single phase solution having as a major constituent one or more compounds of the glycol-ether group, and a minor portion of the total volume of the cleaning composition being at least one of the compounds from one of the alcohol and ketone chemical groups. The cleaning composition of the disclosure has a phased (timed) evaporation rate, leaves no residue, is non-flammable, is biodegradable, can be vented to the atmosphere, and does not contaminate the lubricating oil of refrigeration systems.

3 Claims, No Drawings

CLEANING COMPOSITION FOR PIPES AND COILS OF A REFRIGERATION SYSTEM

This is a continuation of application Ser. No. 08/238,919, filed May 6, 1994, now abandoned.

BACKGROUND OF THE INVENTION

1. Field of the Invention

The invention relates to a composition which due to its cleaning abilities can break down, liquify, and clean away oil, grease, tar, and carbon residue deposits from the interior walls of pipes and coils connected to compressors of domestic and commercial refrigeration systems. When the compressor of a refrigeration system fails, the heat generated by the failure of the compressor results in refrigeration oil being transformed into tar and carbon deposits which line the interior walls of the pipes and coils of the refrigeration system and thereby render them contaminated. The cleaning composition of the invention is safe for both the individuals cleaning the pipes and coils of such refrigeration systems as well as the environment. The composition of the invention is free from ozone depleting substances, can be safely released into the atmosphere, is biodegradable, and replaces both flammable and chlorinated solvents.

2. Description of the Prior Art

Solvents and related preparations for breaking down, liquefying, and cleaning away oil, grease, tar and carbon residue deposits from the interior walls of pipes and coils attached to compressors of domestic and commercial refrigeration systems have been typically hazardous to both the environment and the individuals working with such systems. Such solvents and related preparations typically contain ozone depleting chlorinated substances which are released into the atmosphere, are non-biodegradable, and/or are flammable.

SUMMARY OF THE INVENTION

The invention provides a stable multi-purpose cleaning composition for cleaning the pipes and coils of domestic and commercial refrigeration systems. The cleaning composition comprises a single phase solution having as a major constituent one or more compounds from the glycol-ether group, including diethylene glycol monobutyl ether, dipropylene glycol monomethyl ether, tripropylene glycol methyl ether, propylene glycol methyl ether acetate, dipropylene glycol methyl ether acetate, and ethylene glycol n-butyl ether, as well as a minor portion of the total volume of at least one of the compounds from the alcohol and/or ketone chemical group. The alcohol group includes, butanol, propanol, ethanol, methanol, and isopropanol. The ketone group includes methyl ethyl ketone, methyl propyl ketone, methyl butyl ketone, ethyl propyl ketone, ethyl butyl ketone, and propyl butyl ketone.

The cleaning composition of the invention has a phased (timed) evaporation rate, leaves no residue, is non-flammable, is biodegradable, can be vented to the atmosphere, and does not contaminate the lubricating oil of refrigeration systems.

DESCRIPTION OF THE PREFERRED EMBODIMENTS

In accordance with the invention, compounds from the glycol-ether group, blended with compounds from the alcohol and/or ketone groups, produce an environmental safe composition with a "phased" evaporation rate and with above average cleaning abilities which can break down, liquify and clean away oil, grease, tar and carbon residue deposits from the interior walls of pipes and coils connected to compressors of domestic and commercial refrigeration systems.

The need for the composition of the invention is especially important when there is a failure of the compressor motor in a refrigeration system. The heat generated from the compressor motor failure results in refrigeration oil being transformed into tar and carbon deposits which line the interior walls of the pipes and coils of the refrigeration system, thereby rendering them ineffective for heat transfer functions. If these contaminants are not removed, they can cause a repaired or replacement compressor motor to fail again. A severe burnout occurs when the contaminants resulting from an overheated motor are pumped through the refrigerant system while the motor can still run. The contaminants created by a burnout can include moisture, acid, soot, varnish and hard carbon, and copper plating. Overheating of the motor can release moisture which will travel through the refrigeration system. Moisture and dirt can also enter a refrigeration system through careless assembly, service or maintenance. Moisture in a refrigeration system can cause oil sludge which reduces the lubrication properties of the oil and blocks oil passages and screens. Moisture can also react with the refrigerant to form hydrochloric and hydrofluoric acid. These acids can cause corrosion of metals and breakdown of the insulation of the motor windings. If such acids cut through the insulation on the terminal wires of the compressor motor, the motor will short out and fail.

Soot, another contaminant, is generally a soft carbon material caused by charring of the insulation and oil. It is usually confined to the compressor unless the compressor continues to run for an extended period of time after the burnout. Varnish and hard carbon are cause by excessive heat and are the most difficult of all contaminants to remove. Because the compressor is the warmest element in the system at the time of the burnout, most of the varnish and carbon deposits occur in the compressor. Copper plating is the result of a combination of factors such as moisture, the type of refrigerant used, and excessive temperatures. Copper ions are carried to bearing surfaces where they are deposited. The gradual build-up of copper on bearing surfaces reduces the clearances and results in increased friction and wear and eventual seizure. To prevent failure, the contaminants created by a compressor motor burnout must be removed from the system before placing it back into operation.

While satisfying the need for an effective interior pipe and coil cleaner, the invention is also safe to both the environment and to the individuals working with refrigeration systems. The composition of the invention is free from ozone depleting substances, can be released into the atmosphere, is biodegradable, and replaces both flammable and chlorinated solvents. The composition of the invention is blended using groups of compounds to produce a "timed or "phased" evaporation rate which enables the composition of the invention to evaporate in stages, thereby eliminating the possibility that any residue remains within the pipes and coils of the refrigeration system. The glycol-ether group is particularly effective in breaking down, liquefying and cleaning away oil, grease, tar, and carbon, which are found on the interior walls of the pipes and coils of refrigeration systems, both before and after failure of a compressor and the heat generated by such failure.

The cleaning composition comprises a solution such as a single phase solution having as a major constituent of one or more compounds from the glycol-ether group including ethylene-glycol based glycol ethers of:

diethylene glycol monobutyl ether;

ethylene glycol n-butyl ether;

diethylene glycol monomethyl ether;

diethylene glycol monoethyl ether;

ethylene glycol monopropyl ether;

diethylene glycol monopropyl ether;

ethylene glycol monobutyl ether; and including propylene glycol-based glycol ethers of:

tripropylene glycol methyl ether;

propylene glycol methyl ether acetate;

dipropylene glycol monomethyl ether;

propylene glycol monopropyl ether;

propylene glycol monomethyl ether;

propylene glycol monobutyl ether; and dipropylene glycol monopropyl ether.

The cleaning composition also comprises a solution such as a single phase solution having as a major constituent of one or more compounds from the glycol-ether group including propylene-glycol based glycol ethers of trimethylene glycol monomethyl ether and trimethylene glycol monoethyl ether.

The cleaning composition further comprises a solution having a minor constituent of one or more compounds from the alcohol and/or ketone chemical group.

The alcohol group includes:

butanol propanol ethanol methanol, and isopropanol.

The ketone group includes:

methyl ethyl ketone;

methyl propyl ketone;

methyl butyl ketone;

ethyl propyl ketone;

ethyl butyl ketone;and propyl butyl ketone.

By way of example, the major constituent of the cleaning composition may be at least 85% of compounds from the glycol-ether group. Further by way of example, the minor constituent of the cleaning composition may be up to 15% of the compounds from at least one or a mixture of the alcohol and ketone chemical group.

PROPERTIES OF ALCOHOL COMPOUNDS

I. IDENTIFICATION

| | | |
|---|---|---|
| Product Name: | Isopropanol, anhydrous | |
| Chemical Name: | Isopropyl alcohol | Chemical Family: alcohols |
| Formula: | $(CH_3)_2CHOH$ | Molecular Weight: 60.10 |
| Synonyms: | Isopropyl alcohol; | 2-propanol; dimethyl carbinol |
| CAS # 67-63-0 | CAS Name | 2-Propanol |

II. PHYSICAL DATA

| | | | |
|---|---|---|---|
| Boiling Point, 760 mm Hg | 82.26° C. (180.07° F.) | Freezing Point | −88.5° C. (−127.3° F.) |
| Specific Gravity ($H_2O$ = 1) | 0.7864 AT 20/20° c. | Vapor Pressure At 20° C. | 33 mm Hg |
| Vapor Density (air = 1) | 2.07 | Solubility In Water, % by wt. | Complete at 20° |
| Percent Volatiles By volume | 100 | Evaporation Rate (butyl acetate = 1) | 2.88 |
| Appearance and Odor | | Colorless liquid; characteristic odor | |

GLYCOL PROPERTIES

1. Physical Data: Chemical name: Dipropylene Glycol Monomethyl Ether
   Chemical family: Glycol Ethers
   Boiling Point: 363 F., 104 C.
   VAP Press: .55 mmHg @ 25 C.
   VAP Density: 5.14
   SOL. in Water: Infinitely
   SP. Gravity: .950 25/25 C.
   Appearance: Clear, colorless liquid.
   Odor: Information not available.
2. Fire and Explosion Hazard Data:
   Flash Point: 175 F.
   Method Used: TCC
   Flammable Limits
   LFL: 1.1 vol % @ 100 C.
   UFL: 14 vol % @ 150 C.

GLYCOL PROPERTIES
I. IDENTIFICATION

| | |
|---|---|
| Chemical Name: | Diethylene glycol monobutyl ether |
| Chemical Family: | Glycol ethers |
| Formula: | C4H9O(C2H4O)2H |
| Molecular Weight: | 162.23 |
| Synonyms: | Butoxydiethylene glycol; 2-(2-butoxyethoxy) ethanol;butoxy diglycol |
| CAS # and Name: | 112-34-5 |

-continued

Ethanol, 2-(2-butoxyethoxy)

II. PHYSICAL DATA

| | | |
|---|---|---|
| Boiling Point, 760 MM Hg: | 230.6 C. | 447.1 F. |
| Specific Gravity (H2O = 1): | 0.9536 | AT 20/20 C. |
| Freezing Point: | −68.1 C. | −90.6 F. |
| Vapor Pressure AT 20'C.: | 0.01 | mmhG at 20 C. |
| Vapor Density (AIR = 1): | 5.6 | |
| Evaporation Rate (Butyl Acetate = 1): | <0.01 | |
| Solubility in Water by wt: 100% AT 20 C. | | |

KETONE PROPERTIES

CAS # 000078-93-3
Formula: CH (3)COC(2)H(5)
Chemical Family: Ketone
Chemical Name and Synonyms: MEK; 2 butanone

| Ingredient | Percent | TLV |
|---|---|---|
| Methyl ethyl ketone (MEK) | 100 | PEL/TLV |
| 200 ppm | | |
| (2 Butanone) | | STEL 2 = 300 ppm |
| (CAS #78–93)<> | | OSHA/ACGIH |

PHYSICAL/CHEMICAL PROPERTIES OF CLEANING COMPOSITION

Boiling Point (°F.): 377 Specific Gravity ($H2_o$ = 1) : .936
Vapor Pressure @70° F:.304 Melting Point: none
Vapor Density(Air=1):5.06 Evaporation Rate:
Solubility in Water: Complete (Butyl acetate = 1): .838
Appearance & Odor: Clear with Characteristic Odor
Flash Point (°F.): 179 Flammability Limit: Let 1.1 UEL 13.5
Extinguishing Media: Water Fog, CO2, Dry chemical, Universal Foams.
Composition has autoignition temperature of approximately 350 Degrees F.

Examples of the Cleaning Composition of the Inventiton by Volume are:

| Example No. | Diethylene Glycol Monobutyl Ether | Methyl Dipropylene Glycol Monomethyl Ethers | Isopropyl Alcohol | Ethyl Ketone |
|---|---|---|---|---|
| 1 | 50% | 40% | 6% | 4% |
| 2 | 19–80% | 19–80% | 1–15% | 0% |
| 3 | 19–80% | 19–80% | 0 | 1–15% |

The maximum percentage of the major constituent of the cleaning composition from the glycol-ether group must be no more than 99% with the balance being at least one of the compounds of the alcohol and ketone chemical groups. In order to insure that the cleaning composition is non-flammable, the minor constituent of one or more of the compounds from the alcohol and ketone groups must be not more than 15% with the balance being at least one of the compounds from the glycol-ether group. In order for the cleaning composition to retain its phased (timed) evaporation rate, the minor constituent must comprise no more than 15% of one or more of the compounds from the alcohol and/or the ketone chemical groups.

In use, the cleaning composition is introduced into the pipe and coil configuration of a refrigeration system following a failure of the system such as that of the compressor motor which results in contamination and deposits on the interior surfaces of the pipes and coil. When the compressor with the motor is removed after failure, access is made available to the pipes and coils. The cleaning composition is then introduced by pumping or by gravity flow into the pipes and coils. The cleaning composition is then left within the pipes and coils for a period of time to enable the cleaning composition to dissolve any oil, grease, tar, and carbon residues within the pipes and oils. The cleaning composition with the dissolved contaminants are then permitted to flow out of the pipes and coils. Thereafter any cleaning composition remaining within the pipes and coils will rapidly evaporate.

The cleaning composition with the dissolved contaminants therein can also be removed from the pipes and coils by applying pressured gas or compressed air to the pipes and coils, thereby discharging the cleaning composition and the dissolved contaminants therein.

Once the cleaning composition is removed from the pipes and coils with the dissolved contaminants, the refrigeration system is immediately ready for reassembly, i.e. the connecting of a replacement or repaired compressor, the sealing of the system, and finally the recharging of the system with refrigerant.

What is claimed is:

1. A stable cleaning composition for cleaning the interior surfaces of refrigeration systems, the composition being free of ozone depleting substances, biodegradable, non-flammable, and free of contaminates of the lubricating oil of a refrigeration system, and having a timed evaporation rate, the composition consisting of 85 to 99% by volume of compounds from at least one of the glycol-ether group wherein said compounds are selected from the group consisting of ethylene glycol-based glycol ethers of diethylene glycol monobutyl ether, ethylene glycol n-butyl ether, diethylene glycol monomethyl ether, diethylene glycol monoethyl ether, ethylene glycol monopropyl ether, diethylene glycol monopropyl ether, ethylene glycol monobutyl ether, and mixtures thereof, and of propylene glycol-based glycol ethers of tripropylene glycol methyl ether, propylene glycol methyl ether acetate, dipropylene glycol monomethyl ether, dipropylene glycol methyl ether acetate, propylene glycol monopropyl ether, propylene glycol monomethyl ether, propylene glycol monobutyl ether, dipropylene glycol monopropyl ether, trimethylene glycol monomethyl ether, trimethylene glycol monoethyl ether, and mixtures thereof; and 1 to 15% by volume of the stable cleaning composition of at least one compound selected from the group consisting of alcohols and ketones wherein the alcohol is selected from the group consisting of butanol, propanol, ethanol, methanol, isopropanol, and mixtures thereof, and the ketone is selected from the group consisting of methyl ethyl ketone, methyl propyl ketone, methyl butyl ketone, ethyl propyl ketone, ethyl butyl ketone, propyl butyl ketone, and mixtures thereof.

2. A stable cleaning composition in accordance with claim 15 in which at least 90% by volume of the composition is compounds from the glycol-ether group.

3. A stable cleaning composition in accordance with claim 1 in which the stable cleaning composition is a single phase solution.

* * * * *